US005462208A

United States Patent [19]

Stahley et al.

[11] Patent Number: 5,462,208

[45] Date of Patent: Oct. 31, 1995

[54] TWO-PHASE DISPENSING SYSTEMS UTILIZING BELLOWS PUMPS

[75] Inventors: Robert E. Stahley, Middletown; Mark T. Lund, West Chester; Dimitris I. Collias, Cincinnati, all of Ohio

[73] Assignee: The Procter & Gamble Company, Cincinnati, Ohio

[21] Appl. No.: 283,885

[22] Filed: Aug. 1, 1994

[51] Int. Cl.[6] ..... B65D 37/00

[52] U.S. Cl. ..... 222/207; 222/190; 222/209; 222/321.9; 239/330

[58] Field of Search ..... 222/207, 209, 222/212, 215, 135, 145, 211, 321, 321.1, 321.7, 321.9, 190, 630–634; 239/372, 330

[56] References Cited

U.S. PATENT DOCUMENTS

| | | | |
|---|---|---|---|
| 862,867 | 8/1907 | Eggleston . | |
| 2,774,518 | 12/1956 | Greene | 222/209 |
| 2,833,448 | 5/1958 | Lerner | 222/209 |
| 3,162,335 | 12/1964 | Kogan et al. | 222/212 |
| 3,406,909 | 10/1968 | Pfeiffer | 222/321 X |
| 3,473,524 | 10/1969 | Drewe | 222/215 X |
| 3,910,458 | 10/1975 | Ewald | 222/209 X |
| 3,973,700 | 8/1976 | Schmidt et al. | 222/153 |
| 3,976,223 | 8/1976 | Jass et al. | 222/94 |
| 4,340,154 | 7/1982 | VanManen | 222/94 |
| 4,420,098 | 12/1983 | Bennett | 222/190 |
| 4,640,440 | 2/1987 | Ford, Jr. et al. | 222/190 |
| 4,801,046 | 1/1989 | Miczka | 222/95 |
| 4,863,070 | 9/1989 | Andris | 222/207 |
| 4,880,161 | 11/1989 | Wright | 239/330 |
| 4,898,307 | 2/1990 | Tiramani | 222/207 |
| 4,957,218 | 9/1990 | Ford, Jr. | 222/1 |
| 4,972,977 | 11/1990 | Moss et al. | 222/207 |
| 4,979,646 | 12/1990 | Andris | 222/136 |
| 5,014,881 | 5/1991 | Andris | 222/207 |
| 5,024,243 | 6/1991 | Snyder | 222/207 X |
| 5,129,550 | 7/1992 | Eschbach | 222/135 |
| 5,205,441 | 4/1993 | Andris | 222/207 |
| 5,238,150 | 8/1993 | Williams | 222/95 |
| 5,271,530 | 12/1993 | Uehira et al. | 222/321 X |
| 5,289,948 | 3/1994 | Moss et al. | 222/145 X |
| 5,289,952 | 3/1994 | Gueret | 222/189 |
| 5,303,867 | 4/1994 | Peterson | 239/333 |
| 5,326,000 | 7/1994 | Fuchs | 222/321 |
| 5,351,862 | 10/1994 | Weag | 222/145 |
| 5,353,961 | 10/1994 | Debush | 222/94 |

FOREIGN PATENT DOCUMENTS

| | | |
|---|---|---|
| 171462 | 11/1984 | European Pat. Off. . |
| 1459735 | 11/1966 | France . |
| 2007199 | 1/1973 | Germany . |
| 3616-152 | 11/1987 | Germany . |
| 3837-704 | 5/1990 | Germany . |
| 3909633 | 10/1990 | Germany . |

*Primary Examiner*—Kevin P. Shaver
*Attorney, Agent, or Firm*—William Scott Andes; Michael E. Hilton; Daniel F. Nesbitt

[57] ABSTRACT

The present invention provides a manually operated dispensing system for dispensing a liquid product in atomized or foam form. More particularly, the present invention provides an improved manually operated pump to for use in such dispensing systems which incorporates at least one collapsible bellows as a pump chamber. The use of a bellows as the air chamber in an air/liquid pump mechanism allows the pressure/volume profile of the air supply to be tailored to supply the desired air/liquid ratio throughout the travel of the pump mechanism. The shape of the air bellows is preferably selected to provide an is initially large volume reduction in the air chamber as the bellows collapses to provide a rapid rise in air pressure available for dispensing. In a preferred embodiment, dual bellows are utilized (one for liquid, one for air) in a concentric arrangement to allow the pressure/volume profile for each to be tailored to achieve the desired spray or foam characteristics. Inlet and outlet valves are unitarily formed with the liquid bellows and the use of a pre-compression mechanism for the liquid outlet valve allows the air pressure to build to the level required for satisfactory performance before the liquid begins to flow.

19 Claims, 6 Drawing Sheets

TWO-PHASE DISPENSING SYSTEMS UTILIZING BELLOWS PUMPS

FIELD OF THE INVENTION

The present invention pertains to dispensing systems for dispensing a liquid product in combination with a gas. More particularly, the present invention pertains to manually operated dispensing systems for dispensing a liquid product in combination with air to produce an atomized spray or foam of product.

BACKGROUND OF THE INVENTION

Many liquid products are dispensed in combination with a gas in order to provide an atomized spray or a foam of the product. Such products may include, for example, hair sprays, anti-perspirants, deodorants, and fragrances, (in atomized form) and lotions, depilatories, mousses, and soaps (in foam form). Dispensing systems useful for dispensing such products include pressurized (aerosol) type containers, deformable containers, and manually-actuated pump mechanisms.

Negative consumer perceptions associated with aerosol containers and deformable containers for atomized or foamed products have led to a heightened interest in manually-actuated pump mechanisms. Currently commercially available pump mechanisms of this variety utilize two or more pumping chambers to separately supply the liquid product of interest along with a gas (hereinafter referred to generically as "air", the most common gas used) to a foaming or atomizing nozzle where they are combined to produce a foam or spray.

Some commercially available pump mechanisms include two or more piston and cylinder pump chambers, often concentrically arranged, which are synchronously actuated to pump the liquid and the air toward the nozzle. Such pump chambers require that a liquid-tight moving seal be maintained between the piston and the cylinder. A significant amount of friction is generated as the piston moves against the cylinder, resulting in a comparatively high pumping effort. Friction also leads to wear of the pump components, resulting in degradation of performance during the service life of the pump mechanism. Such pump mechanisms also include a comparatively large number of moving and non-moving parts which must be individually manufactured and assembled.

Piston and cylinder pump chambers are, of necessity, of constant cross section (typically cylindrical) from one end to the other so that the piston may be maintained in constant contact with the cylinder. This arrangement produces a given overall ratio of air to liquid. Although this ratio may be tailored by selection of the relative cross-sectional areas (and hence the volumes) of the air and liquid cylinders, the instantaneous ratio at any given point during the pump stoke does not equal the tailored volumetric ratio, due to the fact that air is compressible and the liquid is essentially incompressible. This results in a mixture of air and liquid with no constant air to liquid ratio during the stroke. Furthermore, liquid under pressure begins to be discharged before the air pressure can build up and overcome the pressure drop in the passage leading to the nozzle. This substandard initial instantaneous air/liquid ratio results in a poor quality spray or foam at the beginning of the dispensing cycle until the air pressure rises to the minimum level required for satisfactory performance.

In order to address the shortcomings of piston/cylinder type pump mechanisms, other commercially available pump mechanisms have been developed which utilize pump chambers with collapsible walls, such as flexible, resilient bellows. Two or more bellows are typically used to define corresponding pump chambers, often concentrically arranged, which are synchronously actuated to pump the liquid and the air toward the nozzle.

While commercially available bellows-type pumps do address the frictional shortcomings of piston/cylinder pump mechanisms, such pumps utilize bellows of relatively constant cross-section from one end to the other, and frequently similar cross-sectional profiles for both the liquid and air bellows. As such, the lack of ability to provide sufficient air at the early portion of the pump stroke as discussed above and the lack of ability to tailor the instantaneous air/liquid ratio during the pump stroke exist even in these pump mechanisms.

In addition, a further shortcoming of both the commercially available piston/cylinder pump mechanisms and multiple bellows pump mechanisms is the lack of an effective means of preventing liquid from the nozzle region from draining back downward into the air chamber during the decompression phase of the pump stroke. This drainage may build up residue and reduce the volume of the air chamber, as well as clogging valves and moving components and possibly promoting microbial growth.

Accordingly, it would be desirable to provide a manually-actuated pump mechanism for use in liquid dispensing systems which would provide for an improved air/liquid ratio profile throughout the course of a dispensing cycle. It would also be desirable to provide a manually-actuated pump mechanism for use in liquid dispensing systems which would include a reduced number of moving parts and hence be economical to produce and reliable in service.

SUMMARY OF THE INVENTION

The present invention provides a manually-actuated pump for dispensing a liquid in combination with a gas which includes a gas chamber enclosed by a gas bellows. The gas bellows is collapsible in response to actuation of the pump to dispense a gas in combination with the liquid at an instantaneous predetermined ratio which is variable or constant, as desired, during the course of actuation of the pump.

The gas bellows has a structure adapted to collapse in a pre-determined pattern as the pump is actuated, resulting in an initially relatively large volumetric change in the internal volume of the gas chamber per unit length of an actuation stroke followed by decreased volumetric change in the internal volume of the gas chamber per unit length of an actuation stroke.

In a preferred embodiment, both the liquid and gas chambers are enclosed by flexible bellows, with the liquid chamber dispensing the liquid at a substantially constant volume per unit length of an actuation stroke. The gas bellows preferably has a hybrid frusto-conical/cylindrical shape to provide an initially high rate of gas delivery followed by relatively constant gas delivery during the remainder of the pump stroke.

BRIEF DESCRIPTION OF THE DRAWINGS

The present invention will be better understood with reference to the following Detailed Description and to the accompanying Drawing Figures, in which.

Figure 1:
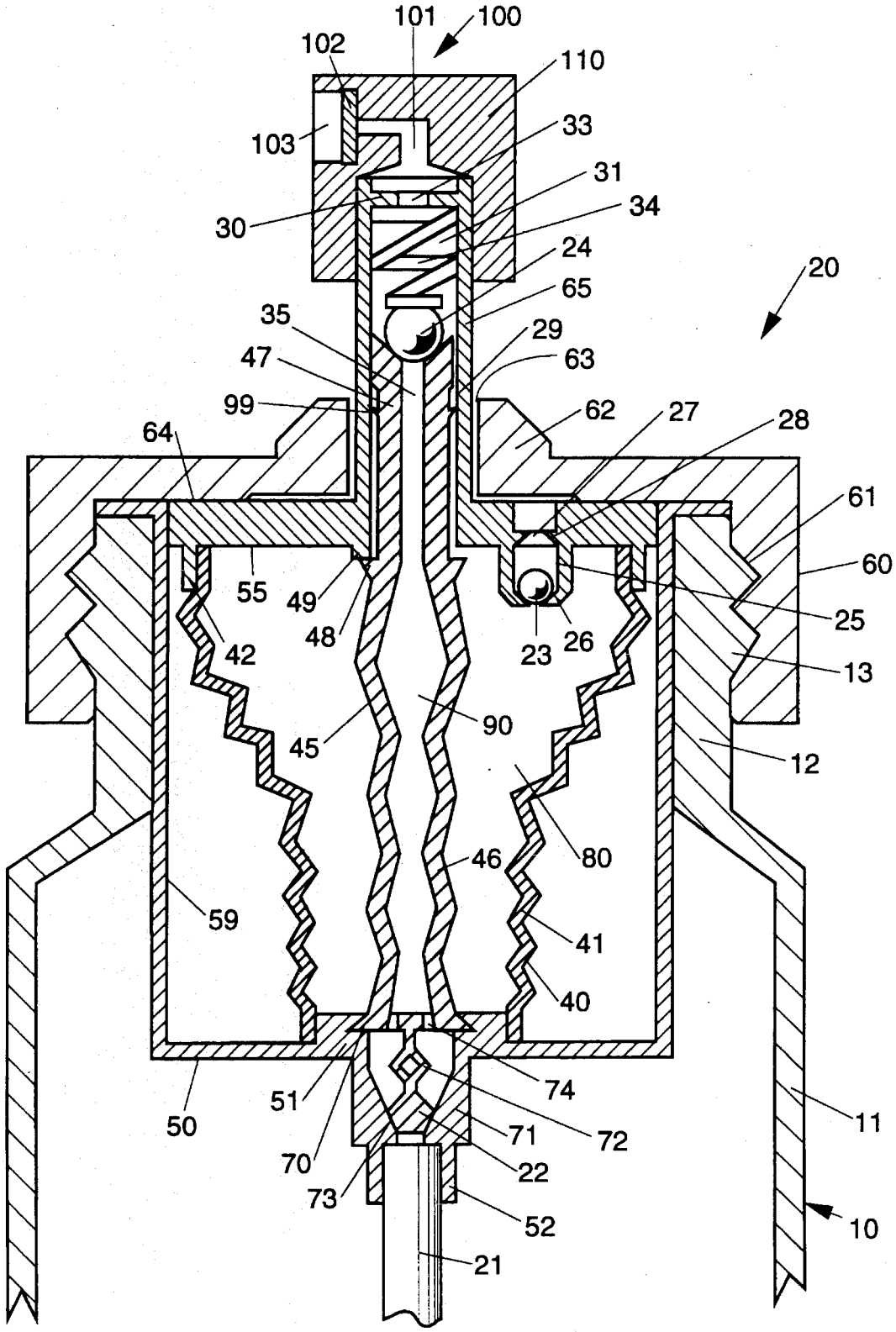
FIG. 1 is an elevational sectional view of a presently preferred bellows pump according to the present invention, shown in the "rest" position.

Unless otherwise indicated, like elements are identified by like numerals throughout the Drawing Figures. In addition, for clarity some elements common to various embodiments of the present invention are not separately labeled in each of the Drawing Figures after the first such Drawing Figure in which such an element appears.

DETAILED DESCRIPTION OF THE INVENTION

FIG. 1 illustrates a presently preferred embodiment of a bellows pump according to the present invention, incorporated into a pump foam dispensing system. More specifically, the foam dispensing system comprises container 10, bellows pump 20, and foaming nozzle 100. Container 10 comprises a main body 11 and a threaded neck 12 with external threads 13. Bellows pump 20 comprises a dip tube 21, an integral and resilient liquid-inlet plug valve 22, a ball for the air-inlet check-ball valve 23, and a ball for the liquid-discharge check-ball valve 24. Bellows pump 20 also includes an air bellows 40, a liquid bellows 45, a cup 50, an air piston 55, and a closure 60 with internal threads 61 matching external threads 13. Finally, foaming nozzle 100 typically comprises an inlet conduit 101, a (or a series of) foam refining means (e.g., frit, screen, etc.) 102 mounted in housing 110, and a discharge conduit 103. Foaming nozzle 100 is sealably attached to and in fluid communication with pump 20 through inlet conduit 101 and an air stem 65, and pump 20 is in fluid communication with and attached to threaded opening 12 of container 10 through external threads 13 and matching internal threads 61.

More specifically, the three valves comprise the following structural elements. Plug valve 22 is a continuation of liquid bellows 45, is kept in place in its upper part by a retainer ring 70, and it is housed at the bottom of a housing 71. Similar to a conventional liquid-inlet check-ball valve, the plug valve seals in the "compression" stage of the operation cycle against valve seat 73. Furthermore, under vacuum conditions, flexing section 72 flexes causing the plug valve 22 to unseat in the "decompression" stage of the cycle. Passages 74 allow the region surrounding the flexing section 72 to communicate with liquid chamber 90 such that when the plug valve 22 is unseated, liquid may flow from dip tube 21 to liquid chamber 90. Unitary valves of this type are described in greater detail in U.S. Pat. No. 5,303,867, issued to Peterson on Apr. 19, 1994, which is hereby incorporated herein by reference.

The air-inlet check-ball valve comprises ball 23, a ball retainer ring 25, a number (preferably four or more) of ball retainer fins 26, an air passage 27, and a valve seat 28. Ring 25 seals during the "compression" stage of the operation cycle, whereas fins 26 allow air to fill an air chamber 80 during the "decompression" stage of the same operation cycle. Also, fins 26 are of size and flexibility that allow ball 23 to be pressed into the valve during the assembly stage of pump 20.

The liquid-discharge check-ball valve comprises ball 24, a series (preferably four or more) ball retainer fins 30, a mixing chamber 31, and a pump discharge passage 33. Fins 30 are placed equidistantly around the circumference of air stem 65, and allow the initial foam to pass between them and towards passage 33. As shown in FIG. 1, pump 20 also preferably includes a pre-compression coil spring 34 on top of the liquid-discharge check-ball valve 24. Spring 34 is slid into mixing chamber 31 of air piston 55 until it engages on ball retainer fins 30 and is held in place by pressure exerted from ball 24. Thus, the liquid-discharge check-ball valve will only open after the liquid pressure in liquid channel 35 exceeds the spring resistance. By providing this pre-compression, a foam of desired quality is dispensed regardless of the actuation speed or force. Furthermore, pre-compression ensures that pure liquid or poor-quality foam is not dispensed at the beginning of the actuation. Therefore, the pre-compression feature provides a performance advantage over the prior art.

In terms of bellows, chambers, channels, and piston, pump 20 comprises the following structural elements. Air bellows 40 comprises a main body 41, which encloses an air chamber 80. The upper part of air bellows 40 is attached to air piston 55 by a retainer ring 42, whereas the lower part of the same bellows is attached to cup 50 via a retainer ring 51. Both of the attachments are interference fits. The space between air bellows 40 and liquid bellows 45 comprises air chamber 80. The shape of air bellows 40 is that of an inverted frustum of a cone with its larger base in the top, and the smaller base in the bottom.

Liquid bellows 45 comprises a main body 46, a liquid stem 47, a flange 48, and encloses a liquid chamber 90 and a liquid channel 35. The lower part of liquid bellows 45 is attached to cup 50 at retainer ring 70, while liquid stem 47 contacts a post 49 of air piston 55 via flange 48. Air piston 55 comprises retainer ring for air bellows 42, air stem 65, ball retainer fins 30 for the liquid discharge valve, pump discharge passage 33, ball retainer fins 26 for the air-inlet check-ball valve, air passage 27, valve seat 28, an air channel 29, mixing chamber 31, and posts 49. These posts are preferably four or more in number, and are placed equidistantly along the circumference of air-stem 65, so that air can flow from air chamber 80 to channel 29. Furthermore, a liquid seal 99 is molded integrally into liquid bellows 45. It prohibits any foamable liquid quantity from flowing back into an air chamber 80 through an air channel 29. Accumulation of the foamable product in the air chamber might cause microbial growth over time.

Dip tube 21, which provides the liquid flow path into bellows pump 20, is press fit into cup 50 at a boss 52. Finally, closure 60 comprises threads 61, and a guide 62, which serves as a pilot surface for air stem 65 and leaves an air passage 63 between it and air stem 65.

The preferred material for air bellows 40 and the main body of liquid bellows 45 is any resilient material (e.g. elastomer). The preferred material for all the other pans is any economic plastic, such as polyethylene or polypropylene. Note that liquid stem 47, which is pan of liquid bellows 45, is made more rigid than the main body portion 46 by controlling its thickness. Nevertheless, any other suitable material or combinations of materials can work as well. Also, the useful volumes of air chamber 80 and liquid chamber 90 determine the amount of gas and liquid in the final foam (or equivalently, the density of the foam), and therefore, these volumes can be tailored to achieve a desired foam density and dose. These specifications of materials as well as of volumes of air and liquid have applicability to any of the embodiments of the present invention. Finally, balls 23 and 24 are preferably metallic, as is spring 34, although a wide variety of other materials may be utilized.

It should be noted that air piston 55 is merely guided by the inner surface 59 of cup 50, and a friction seal between these two elements is not required. As such, the sliding relative movement between these two elements does not produce an appreciable amount of friction or resistance to movement. In fact, it is desirable that the free space between air bellows 40 and cup 50 be vented through the air piston/inner surface gap to prevent buildup of pressure or vacuum during a pumping cycle.

At the "rest" position of the pump (after the pump has been primed), the foamable liquid occupies dip tube 21, liquid chamber 90, and liquid channel 35. Also, air fills air chamber 80. Main body of liquid bellows 46 pushes air piston 55 through flange 48 and post 49 to its uppermost position. In this position, air piston 55 touches closure 60 at post 64.

The operation cycle consists of two stages: the first is the "compression" and the second is the "decompression". In the "compression" stage, the consumer actuates the pump by applying a force with downwards direction on foaming nozzle 100. Foaming nozzle 100 may be designed for palm actuation or finger actuation, as desired. The consumer actuation is transmitted from the foaming nozzle to air piston 55 and to liquid bellows 45 through post 49 and flange 48. Air piston 55 compresses the air in air chamber 80, since the air-inlet check-ball valve 23 seats onto valve seat 28 to effectively close the valve. This forces air through air channel 29 into mixing chamber 31.

Simultaneously, the liquid in chamber 90 is pressurized when air piston 55 catches on flange 49 thereby compressing liquid bellows 45 and sealing liquid-inlet valve 22. This pressure acts to overcome the force exerted by pre-compression spring 34 and open the liquid-discharge check-ball valve 24 (by moving the ball toward fins 30), allowing liquid to flow towards mixing chamber 31 where it mixes with air to become an initial coarse foam. The pre-compression effect provided by spring 34 prevents liquid flow during the early phase of pump actuation until the air pressure has risen sufficiently to provide for good mixing and foam generation. Finally, this initial foam enters nozzle 100 and the foam is refined by refining means 102 before exiting at discharge conduit 103. The "fully compressed" position of this stage is reached whenever housing 110 contacts the upper surface of guide 62. When the end of travel is reached and the liquid pressure in liquid chamber 90 falls below the level needed to hold ball 24 away from its seat, the restorative force of spring 34 closes the liquid-discharge check-ball valve.

In the "decompression" stage of the operation cycle, the consumer releases the foaming nozzle, and therefore both liquid bellows 45 and air bellows 40 provide the restoring force by extending and moving liquid stem 47 and air piston 55 upwards. After this occurs, the created vacuum in chamber 90 causes the liquid-inlet valve 22 to open allowing foamable liquid to flow up dip tube 21 and fill both liquid chamber 90 and liquid channel 35. Similarly, the air-inlet check-ball valve opens under the vacuum, so that air flows through air passage 63, through air passage 27, and in between retainer fins 26 into air chamber 80. Finally, both air chamber 80 and liquid channel 35 are full of their respective fluids, air piston 55 stops at post 64, the pump returns to its "rest" position and the operation cycle is complete and ready for the next cycle.

The incorporation of the bellows over the use of pistons, cylinders, and a spring provides several advantages. Firstly, the use of bellows reduces the number of parts in the pump mechanism, which reduces the manufacturing cost and increases the reliability of the dispensing system. Secondly, it eliminates the friction between moving pistons and their cylinders. This results in a low dispensing effort for the consumer, with the additional advantage of increased versatility, i.e., since the dispensing effort is low the consumer can actuate the system in either the counter-top or finger-pump modes. Furthermore, the inverted frusto-conical shape of bellows 40 causes the air pressure inside air chamber 80 to increase initially at a higher rate than that inside a cylindrically-shaped bellows. Consequently, the dead time for air to reach mixing chamber 31 is low, compared to the prior art piston-type pumps. Therefore, the density of the discharged foam is nearly constant during each actuation.

Figure 2:
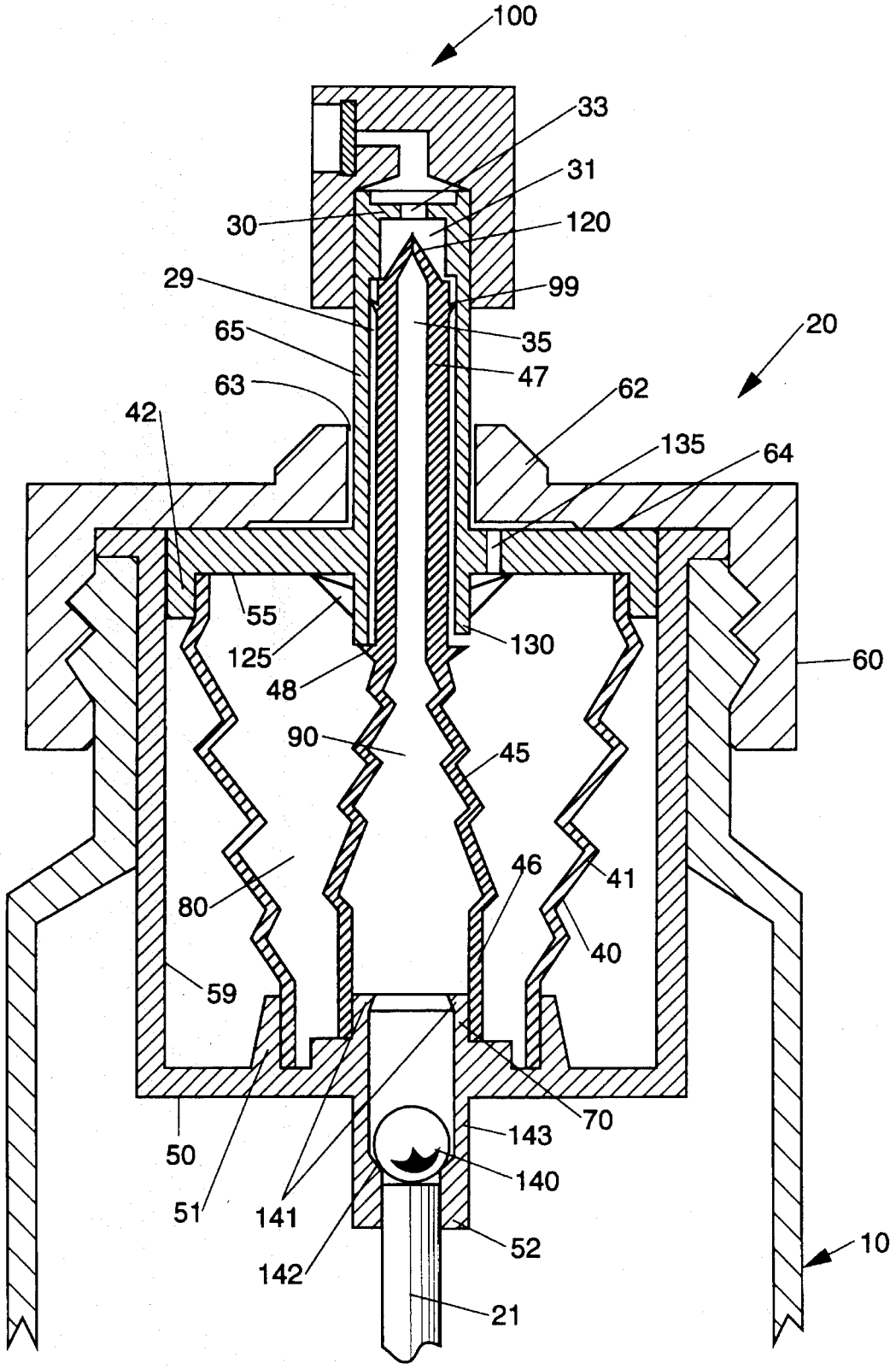
FIG. 2 is an elevational sectional view of another embodiment of a bellows pump according to the present invention, shown in the "rest" position.

FIG. 2 shows a bellows pump according to another embodiment of the present invention. The bellows pump 20 shown in FIG. 2 is similar to the bellows pump of FIG. 1 apart from changes in the liquid-discharge, liquid-inlet, and air-inlet valves. Balls 23 and 24 that served in the air-inlet and liquid-discharge valves have been eliminated to incorporate alternative valves. First, the liquid-discharge valve is now formed by the incorporation of an integral and resilient liquid-discharge duckbill valve 120. Duckbill valve 120 is molded integrally into liquid bellows 45, and at the "rest" position it is closed. However, when the liquid bellows is compressed, the liquid pressure causes the duckbill valve to flex outwardly in the direction perpendicular to the slit, allowing the liquid to pass through the valve.

Duckbill valve 120 has a generally tent-like shape, with two substantially planar sidewalls which meet at an angle to close the end of the liquid passage extending upward from said liquid bellows. The duckbill valve may be designed to utilize the thickness of the bellows material and the shape and thickness of the planar sidewalls to provide a pre-compression feature analogous to that of the coil spring depicted in FIG. 1.

Second, the embodiment of FIG. 2 incorporates a flap valve 125 that slips over a post 130 inside air chamber 80, in place of the air-inlet valve. In the "rest" position as well as during the "compression" stage of the operation cycle, flap valve 125 forms a seal of passage 135. However, during the "decompression" stage of the cycle, flap valve 125 flexes downwards allowing for air to fill air chamber 80.

Third, the liquid-inlet check-ball valve comprises ball 140, ball retainer fins 141, and a valve seat 142, and it is housed in the bottom of a liquid cylinder or housing 143. Fins 141 are small, preferably four or more in number, and placed equidistantly in the circumference of housing 143. Their function is to limit the travel of ball 140, and at the same time to allow foamable liquid to flow past the ball and between them into a liquid chamber 90, during the "decompression" stage of the operation cycle. Furthermore, fins 141 are flexible enough to allow ball 140 to be assembled under force.

The pump embodiment of FIG. 2 offers all the advantages of the previous embodiments, i.e., economic and reliable operation, minimum dispensing work and enhanced versatility, and production of constant density foam form actuation to actuation as well as during any actuation.

Figure 3:
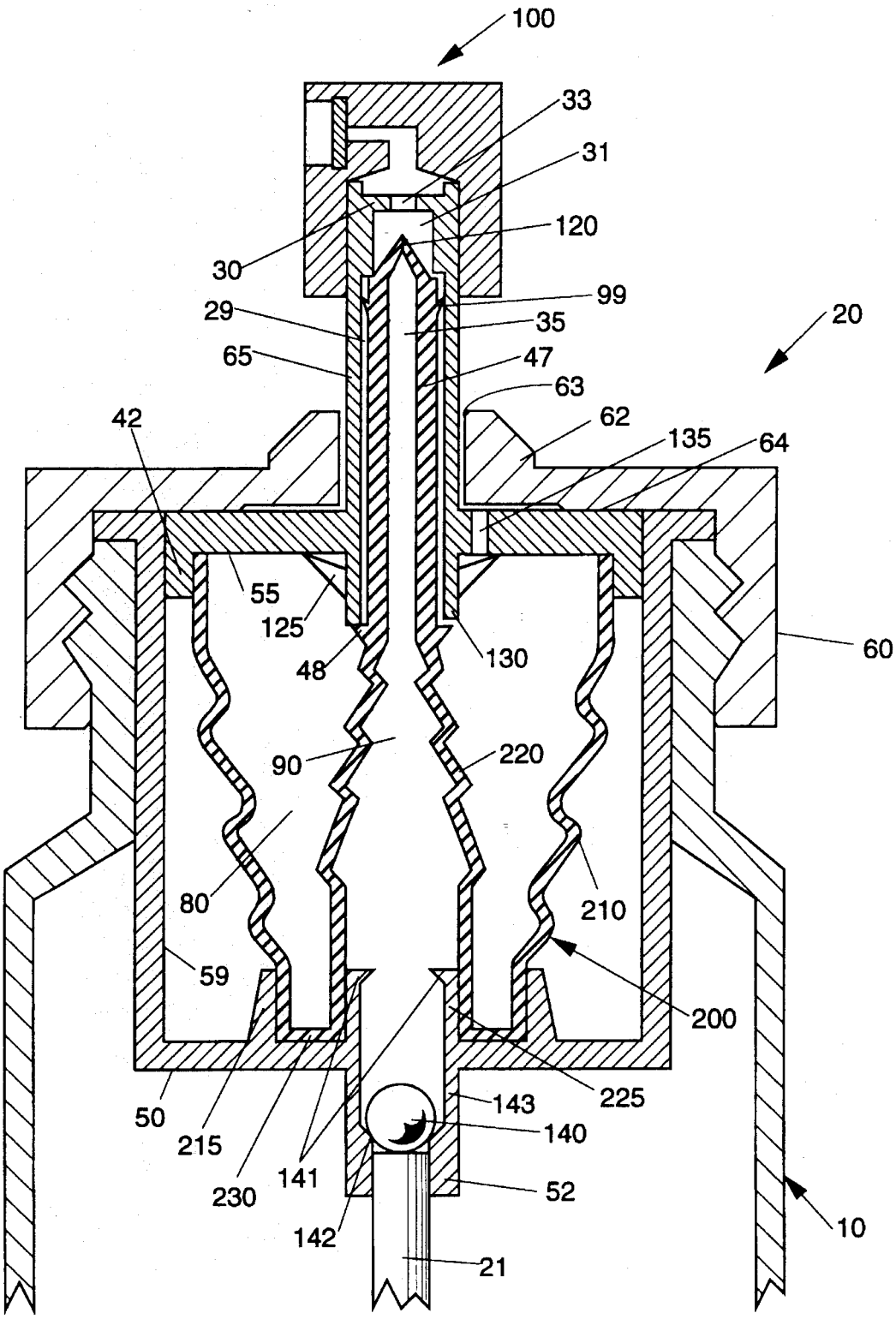
FIG. 3 is an elevational sectional view of a further embodiment of a bellows pump according to the present invention, shown in the "rest" position.
Figure 4:
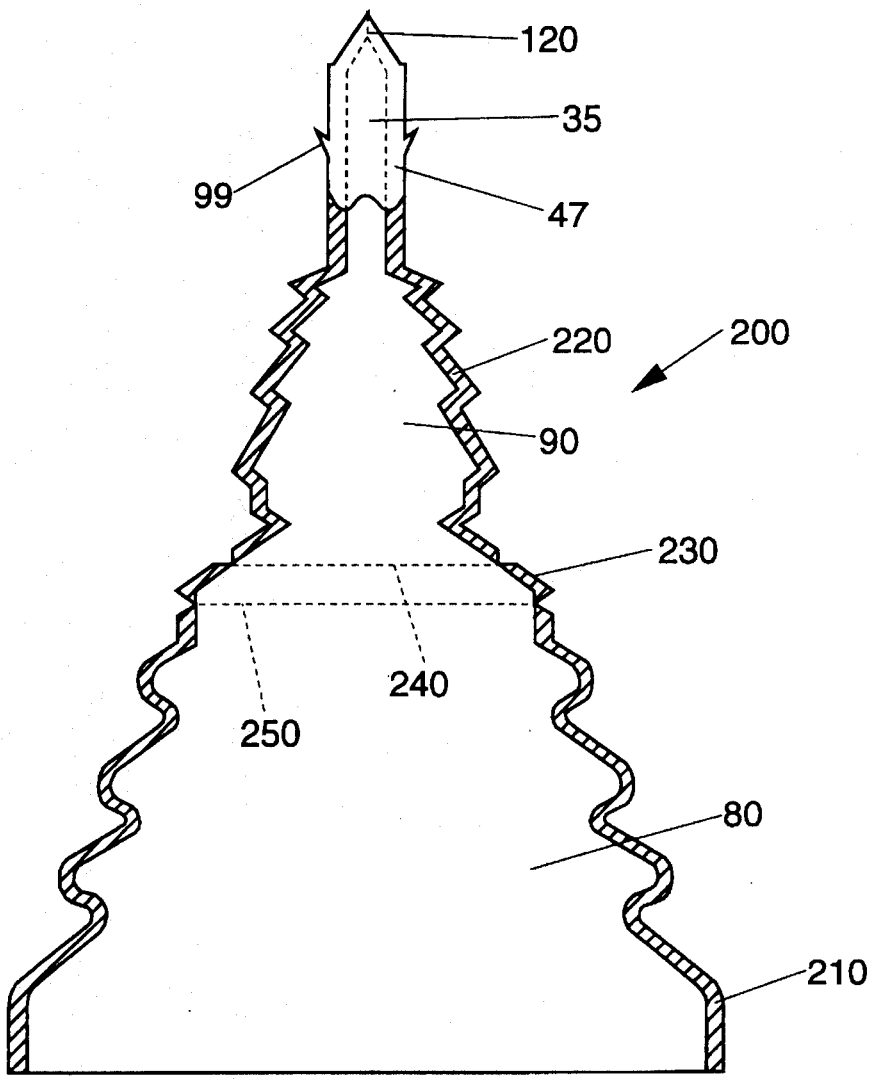
FIG. 4 is an elevational view of the one-piece bellows of FIG. 3 in the "as molded" configuration prior to partial inversion.

FIG. 3 shows a bellows pump according to a further embodiment of the present invention. The bellows pump 20 shown in FIG. 3 is similar to the bellows pump of FIG. 1 apart from the combination of the air and liquid bellows into one bellows 200. Bellows 200, depicted in its "as molded" condition in FIG. 4, is preferably unitarily molded and consists of three sections. The first section comprises an air bellows 210, the second comprises a liquid bellows 220, and the last comprises a transition section 230. This bellows is then inverted (along fold lines 240 and 250, which are the boundaries of transition section 230) and inserted into cup 50 between a ring 215 and a ring 225. More than two fold lines may be utilized to provide for sufficient relief in the bellows material to form the folded comers as shown. By utilizing this bellows construction, an air chamber 80 and a liquid chamber 90 are created with the use of a single bellows. Furthermore, it offers all the main advantages of the previous embodiments, i.e., economic and reliable operation, minimum dispensing work and enhanced versatility, and production of constant density foam form actuation to actuation as well as during any actuation.

Figure 5:
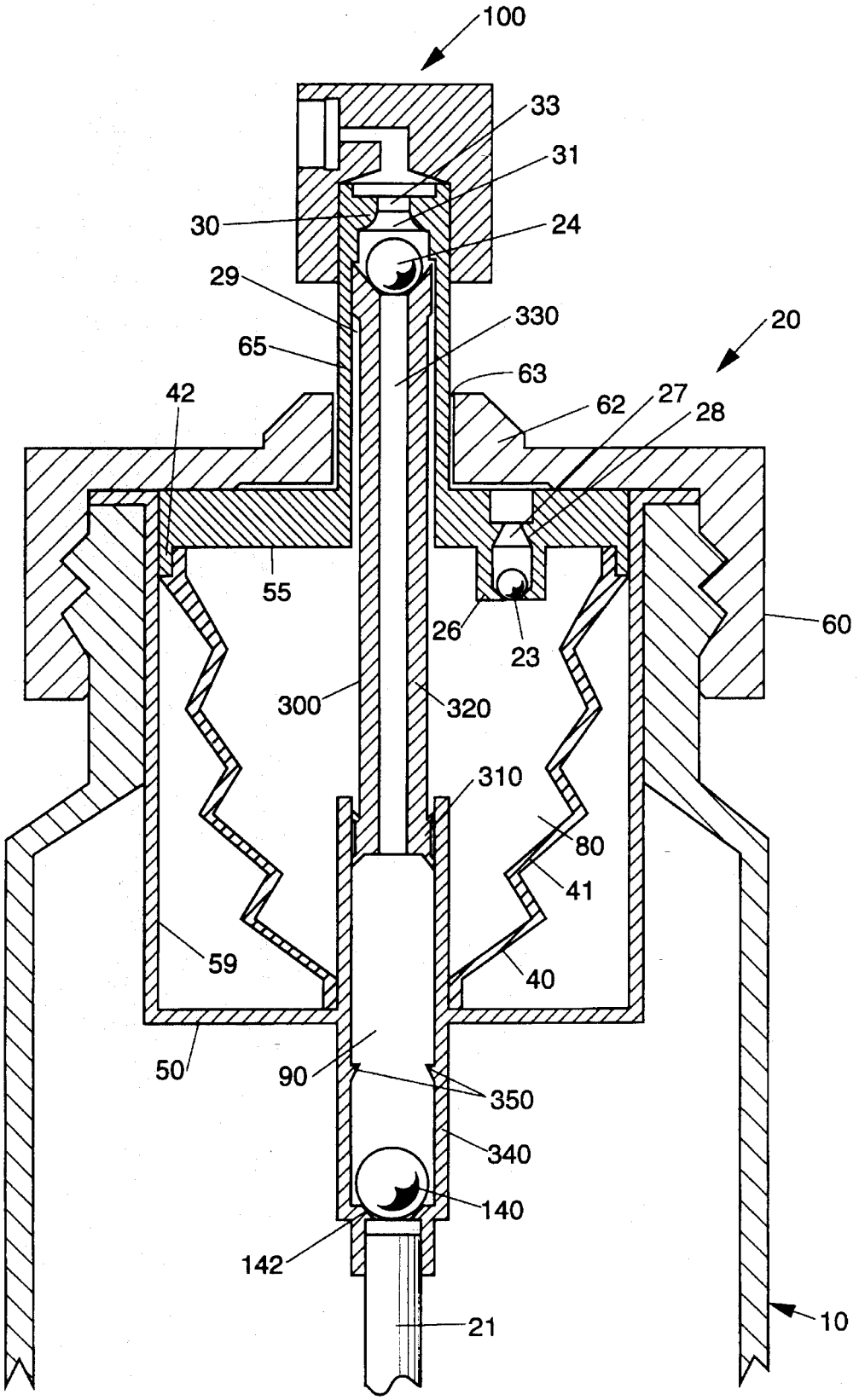
FIG. 5 is an elevational sectional view of yet another bellows pump according to the present invention, shown in the "rest" position.

FIG. 5 shows a bellows pump according to yet another embodiment of the present invention. The bellows pump 20 shown in FIG. 5 is similar to the bellows pumps of FIG. 1 apart from the use of a single bellows for the air chamber. An air bellows 40 forms the walls of an air chamber 80, and is attached the same manner as previously described. However instead of a liquid bellows, a liquid piston 300 is incorporated. Liquid piston 300 comprises a piston skirt 310 and a liquid stem 320, and encloses a liquid channel 330. Liquid piston 300 is connected to an air piston 55 by an interlocking means (not shown) to allow synchronous movement. Typical interlocking means might include press fitting, screws, or any other suitable means. With this change, the restoring force on the return stroke is derived only from the air bellows 40. In operation, piston 300 slides downwards and upwards within a liquid cylinder 340, which defines the liquid chamber 90, in the "compression" and "decompression" stages, respectively. Liquid cylinder 340 preferably also includes travel stops 350 to prevent the lower end of the piston from coming into contact with ball 140. Travel stops 350 also function analogously to the fins 141 of FIG. 2 in retaining the ball 140 in proximity to its seat 142. Finally, this bellows pump offers all the advantages of the previous embodiments, i.e., economic and reliable operation, minimum dispensing work and enhanced versatility, and production of constant density foam form actuation to actuation as well as during any actuation.

Figure 6:
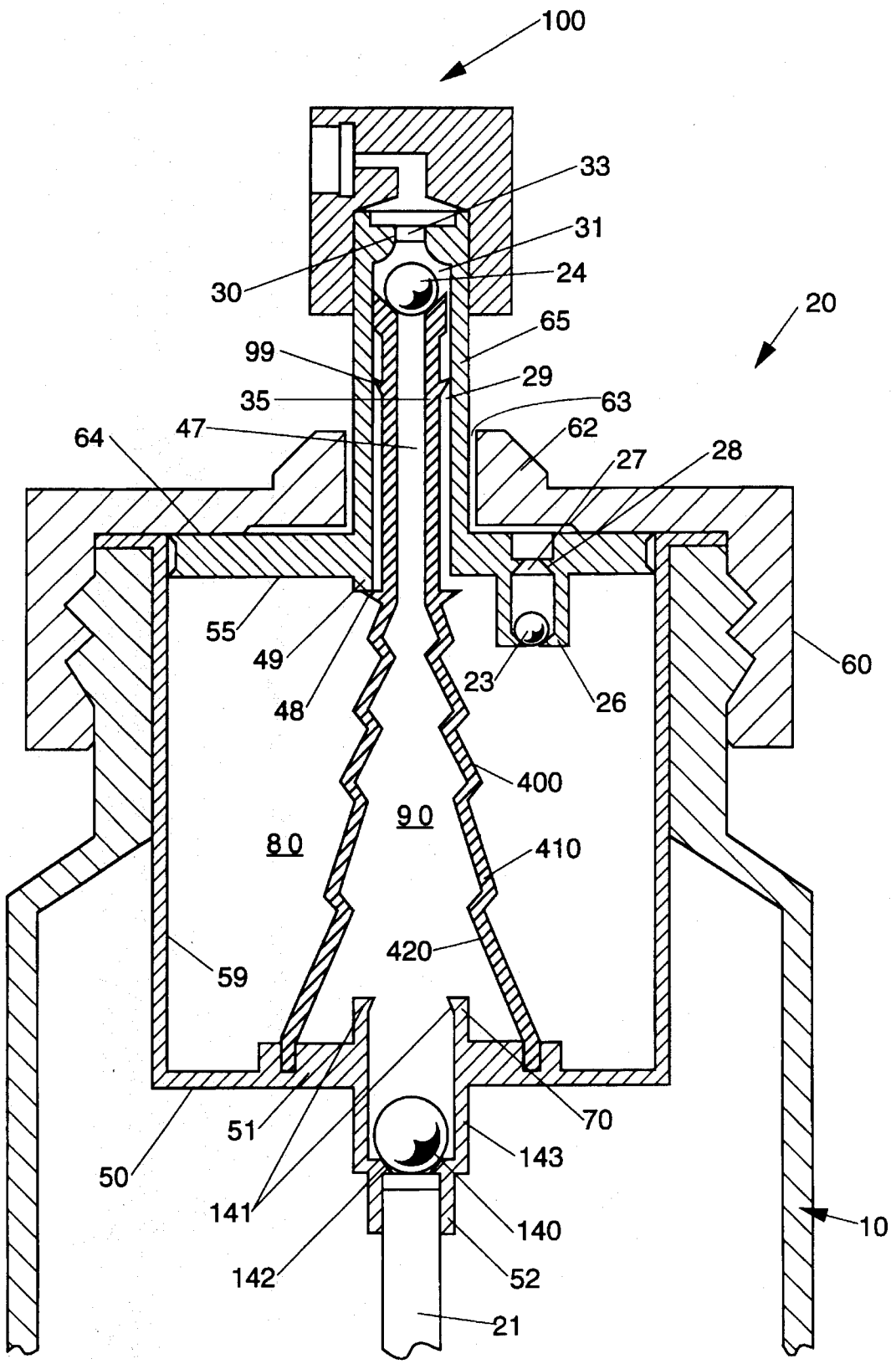
FIG. 6 is an elevational sectional view of still yet another bellows pump according to the present invention, shown in the "rest" position.

FIG. 6 shows a bellows pump according to still yet another embodiment of the present invention. The bellows pump 20 shown in FIG. 6 is similar to the bellows pumps of FIG. 1 apart from the use of a single bellows to divide the air chamber and the liquid chamber. A bellows 400 forms the inner wall 410 of an air chamber 80, with the outer wall of the air chamber 80 being formed by the inner surface 59 of the cup 50. The outer edge of the air piston 55 is therefore designed to form a frictional seal with inner surface 59, unlike the previous embodiments wherein the space between the outer wall of the air bellows and the inner surface 59 was merely vented, idle space. Bellows 400 is attached the same manner as previously described.

Instead of a separate liquid bellows, the bellows 400 also forms the outer wall 420 of the liquid chamber 90. Because of this relationship between walls of the liquid and air chambers, the internal cross-sectional areas of each respective chamber at any given cross section are complementary, i.e, as the bellows becomes narrower the liquid chamber becomes narrower but the air chamber becomes larger. Under normal circumstances, assuming a relatively constant bellows wall thickness and material properties, the bellows will tend to collapse from the larger end first due to the lesser hoop strength of the greater diameter. In order to counteract this tendency and have the bellows collapse from the narrower end (larger air chamber end) first the material properties, pleat angles, and wall thickness of the bellows may be adjusted to make the larger diameter end more collapse-resistant. A more detailed discussion of the bellows tailoring properties may be found in commonly-assigned, co-pending U.S. Patent Application No. 08/204,122, filed Mar. 1, 1994, entitled "Manually Compressible Pump Chamber Having Predetermined Collapsing Pattern", the disclosure of which is hereby incorporated herein by reference. Finally, this bellows pump offers all the advantages of the previous embodiments, i.e., economic and reliable operation, minimum dispensing work and enhanced versatility, and production of constant density foam form actuation to actuation as well as during any actuation.

The shape of air bellows may be tailored to provide the desired ratio of air to liquid in the mixing chamber throughout the dispensing cycle. For example, as depicted in FIG. 2 the bellows 40 may have an inverted frusto-conical shape such that an initially large volume of air is compressed early in the dispensing cycle, followed by a decreasing volume per unit length of the pump stroke as the collapse of the bellows progresses. Preferably, as shown in FIG. 1 the bellows 40 has a portion at its larger end which is frusto-conical in shape, but merges into a cylindrical bellows portion at its narrower end. This hybrid frusto-conical/cylindrical shape provides a rapid initial pressure rise due to the initially large volume of air compressed, transitioning to a constant pressure and volume delivery per unit length of the pump stroke in the proper ratio to the liquid being discharged from the liquid bellows. Other possibilities include non-linear tapering of the bellows, etc.

Tailoring of the shape of the air bellows allows the instantaneous air/liquid ratio to be precisely controlled to achieve the desired dispensing qualities. As such, the compressibility of the air or gas may be accounted for in engineering the output of the air bellows to correspond to the liquid output. Thus, a constant actual instantaneous air to liquid ratio delivered to the dispensing nozzle may be achieved, or any variable instantaneous air/liquid ratio profile desired. The shape of the air/liquid ratio profile versus the position during the course of the pump stroke is thus controlled by the cross-sectional area profile of the gas bellows or, if both bellows have a non-uniform cross-sectional area, by the shapes of both bellows. If the bellows area concentrically oriented within the pump, then the effective cross-sectional area of the outer (typically air) bellows is really the total cross-sectional area minus the cross-sectional area of the inner (typically liquid) bellows.

The bellows may also have conventional angular pleats, as shown in FIG. 1, for example, or a smoother, more rounded pleat as depicted in FIG. 3, or any combination of pleat designs as required for molding purposes or tailoring of the collapse properties of the bellows.

The pre-compression feature is particularly advantageous in combination with the hybrid frusto-conical/cylindrical air bellows shape in that the pre-compression threshold of the spring may be selected to coincide with the end of the transition in the air delivery and begin liquid delivery once the constant pressure and volume delivery portion of the air delivery has begun. This permits the transitional flow phenomena to be avoided and liquid discharge to take place only when sufficient air is already available and flowing through the system. This in turn reduces if not eliminates the presence of a period of poor quality foam or spray at the beginning of the pump stroke.

For embodiments of the present invention which incorporate a liquid bellows, the shape of the liquid bellows may also be tailored to achieve a desired delivery profile. For example, as shown in FIG. 1 the shape of liquid bellows 45 may be essentially cylindrical, i.e., relatively constant from top to bottom, which would provide an essentially constant volume of liquid per given stroke length throughout the dispensing cycle. Alternatively, the profile of the liquid bellows may be generally frusto-conical, as shown in FIG. 2, which would provide a decreasing liquid delivery per stroke length as the delivery stroke progresses.

In addition, embodiments of the present invention utilizing a liquid bellows as shown preferably incorporate the liquid seals 99 for preventing liquid backflow into the air passage and air chamber during the decompression phase. This reduces the likelihood of contamination of the air passage and chamber which may cause microbial growth over time.

Foaming nozzle 100 can be of any type that is able to refine the incoming initial coarse foam into a final fine foam, i.e., to generate a foam with 1) smaller average bubble size, 2) more uniformity in the bubble size distribution, 3) higher viscosity, and 4) more persistence. A suitable foaming nozzle is described in U.S. patent application 08/075,190, filed on Jun. 10, 1993, entitled "Foam Dispensing Nozzles and Dispensers Employing Said Nozzles". Foaming nozzle 100 may also be designed to include an enlarge head suitable for palm actuation rather than the actuation head depicted in the Drawing Figures which is of a type generally adapted for finger actuation.

The density of the foam dispensed from any of the embodiments of the present invention is preferably from about 0.05 g/cm$^3$ to about 0.15 g/cm$^3$, and foam volume is preferably from about 10 cm$^3$ to about 50 cm$^3$. Furthermore, the foam dispensing systems of the present invention can be used to generate foams from any conventional foamable liquid, as long as the material of the liquid bellows is not chemically incompatible with the foamable liquid. Foamable liquids generally comprise a solvent and a surfactant (or surface active agent). Solvent usually comprises about 50 to 99% of the liquid composition, and typical is water, lower alcohols, glycol ethers, and mixtures thereof. The surfactant component can comprise organic, anionic, nonionic, amphoteric, cationic, and mixtures thereof. The viscosity of the foamable liquid is preferably from about 20 cp to about 130 cp.

Although much of the foregoing discussion and the Drawing Figures have focused on the use of the improved bellows pumps of the present invention, it should be understood that the improved bellows pumps may be utilized in other dispensing contexts, such as air-assisted atomization systems. In such a dispenser, the primary difference other than tailoring the pressure profiles and internal volumes would involve substitution of a spray nozzle in place of the foamer head depicted. A suitable spray nozzle for such use is described in U.S. Pat. No. 5,323,935, issued to Gosselin et al. on Jun. 28, 1994, and hereby incorporated herein by reference.

While particular embodiments of the present invention have been illustrated and described, it would be obvious to those skilled in the art that various changes and modifications can be made without departing from the spirit and scope of the present invention. For example, the product composition, the size and shape of the overall dispenser, the type, number, and configuration of the inlet and outlet valves, the dimensions, ratios, clearances, and tolerances of the bellows components, the manufacturing methods, the materials utilized, and their concentrations may all be tailored to suit particular applications. It is intended to cover in the appended Claims all such modifications that are within the scope of this invention.

What is claimed is:

1. A manually-actuated pump for dispensing a liquid in combination with a gas, said pump comprising:

(a) a liquid chamber having a volume which is reduced upon actuation of said pump to dispense said liquid; and (b) a gas chamber enclosed by a gas bellows having a non-uniform cross-sectional area, said gas bellows being collapsible in response to actuation of said pump to dispense said gas in combination with said liquid at a pre-determined gas/liquid ratio, said pre-determined gas/liquid ratio being maintained substantially constant throughout the course of actuation of said pump by said non-uniform cross-sectional area of said gas bellows.

2. The manually-actuated pump of claim 1, wherein said gas bellows has a structure, said structure adapted to collapse in a pre-determined pattern as said pump is actuated, said pre-determined pattern of collapse resulting in an initially relatively large volumetric change in the internal volume of said gas chamber per unit length of an actuation stroke followed by decreased volumetric change in the internal volume of said gas chamber per unit length of an actuation stroke.

3. The manually-actuated pump of claim 1, wherein said liquid chamber comprises a piston and cylinder.

4. The manually-actuated pump of claim 1, wherein said liquid chamber is enclosed by a liquid bellows.

5. The manually-actuated pump of claim 4, wherein said liquid bellows and said gas bellows are unitarily formed.

6. The manually-actuated pump of claim 4, wherein said liquid bellows includes a unitary liquid seal for preventing said liquid from contaminating said gas chamber.

7. The manually-actuated pump of claim 4, wherein said liquid bellows has a substantially cylindrical shape.

8. The manually-actuated pump of claim 4, wherein said liquid bellows includes at least one unitarily-formed liquid valve.

9. The manually-actuated pump of claim 8, wherein said liquid valve has a duckbill shape.

10. The manually-actuated pump of claim 1, wherein said liquid chamber dispenses said liquid at a substantially constant volume per unit length of an actuation stroke.

11. The manually-actuated pump of claim 1, wherein said gas bellows has a substantially frusto-conical shape.

12. The manually-actuated pump of claim 1, wherein said gas bellows has a hybrid frusto-conical/cylindrical shape.

13. The manually-actuated pump of claim 1, wherein said pump includes a liquid outlet valve associated with said liquid chamber, and wherein said liquid outlet valve provides a pre-determined pre-compression threshold for discharge of said liquid.

14. The manually-actuated pump of claim 1, wherein said gas bellows defines an outer side of said liquid chamber and an inner side of said gas chamber.

15. A manually-actuated pump for dispensing a liquid in combination with air, said pump comprising:

(a) a liquid chamber enclosed by a liquid bellows, said liquid bellows being collapsible in response to actuation of said pump to reduce the volume of said liquid chamber and supply liquid under pressure to a mixing chamber;

(b) an air chamber enclosed by an air bellows having a non-uniform cross-sectional area, said air bellows being collapsible in response to actuation of said pump to supply pressurized air in combination with said liquid at a pre-determined air/liquid ratio, said pre-determined air/liquid ratio being maintained substantially constant throughout the course of actuation of said pump by said non-uniform cross-sectional area of said air bellows, said air bellows having a structure, said structure adapted to collapse in a predetermined pattern as said pump is actuated, said predetermined pattern of collapse resulting in an initially relatively large volumetric change in the internal volume of said air chamber per unit length of an actuation stroke followed by a substantially constant volumetric change in the internal volume of said air chamber per unit length of an actuation stroke.

16. A manually-actuated dispensing system for dispensing a liquid product in combination with a gas, said dispensing system comprising:

(a) a container for containing said liquid product;

(b) a nozzle assembly for discharging said liquid product;

(c) a manually-actuated pump for dispensing said liquid product in combination with a gas, said pump including;

(i) a liquid chamber having a volume which is reduced upon actuation of said pump to dispense said liquid product; and (ii) a gas chamber enclosed by a gas bellows having a non-uniform cross-sectional area, said gas bellows being collapsible in response to actuation of said pump to supply pressurized gas in combination with said liquid product at a pre-determined gas/liquid ratio, said pre-determined gas/liquid ratio being maintained substantially constant throughout the course of actuation of said pump by said non-uniform cross-sectional area of said gas bellows.

17. The manually-acutated dispensing system of claim 16, wherein said nozzle assembly includes an atomizing nozzle.

18. The manually-actuated dispensing system of claim 16, wherein said nozzle assembly includes a foaming nozzle.

19. The manually-actuated dispensing system of claim 16, wherein said liquid chamber is enclosed by a liquid bellows.

* * * * *

UNITED STATES PATENT AND TRADEMARK OFFICE

CERTIFICATE OF CORRECTION

PATENT NO. : 5,462,208

DATED : October 31, 1995

INVENTOR(S) : ROBERT E. STAHLEY ET AL.

It is certified that error appears in the above-indentified patent and that said Letters Patent is hereby corrected as shown below:

Column 4, line 65, "pans" should read -- parts --.

Column 4, line 67, "pan" should read -- part --.

Signed and Sealed this

Fifteenth Day of July, 1997

Bruce Lehman

*Attest:*

BRUCE LEHMAN

*Attesting Officer*

*Commissioner of Patents and Trademarks*